US007800432B2

(12) United States Patent
Kudo

(10) Patent No.: US 7,800,432 B2
(45) Date of Patent: Sep. 21, 2010

(54) SEMICONDUCTOR CIRCUIT AND CONTROLLING METHOD THEREOF

(75) Inventor: Masahiro Kudo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 39 days.

(21) Appl. No.: 12/096,539

(22) PCT Filed: Dec. 7, 2005

(86) PCT No.: PCT/JP2005/022488

§ 371 (c)(1),
(2), (4) Date: Jun. 6, 2008

(87) PCT Pub. No.: WO2007/066395

PCT Pub. Date: Jun. 14, 2007

(65) Prior Publication Data

US 2009/0045869 A1 Feb. 19, 2009

(51) Int. Cl.
*G05F 1/10* (2006.01)

(52) U.S. Cl. ..... 327/538; 327/108

(58) Field of Classification Search ..... 327/108, 327/109, 111, 538, 543
See application file for complete search history.

(56) References Cited

U.S. PATENT DOCUMENTS

| | | | | |
|---|---|---|---|---|
| 5,506,541 | A * | 4/1996 | Herndon | 327/541 |
| 6,686,779 | B2 * | 2/2004 | Yoshikawa | 327/108 |
| 7,151,409 | B2 * | 12/2006 | Koen et al. | 330/254 |
| 7,446,577 | B2 * | 11/2008 | Kim et al. | 327/109 |

FOREIGN PATENT DOCUMENTS

| | | | |
|---|---|---|---|
| JP | 61-114319 | | 6/1986 |
| JP | 08-321584 | | 12/1996 |
| JP | 10-209282 | A | 8/1998 |
| JP | 2003-115189 | A | 4/2003 |
| JP | 2003-150258 | | 5/2003 |
| JP | 2004-032070 | A | 1/2004 |
| JP | 2004-213747 | A | 7/2004 |

* cited by examiner

*Primary Examiner*—Jeffrey S Zweizig
(74) *Attorney, Agent, or Firm*—Arent Fox LLP

(57) ABSTRACT

A semiconductor circuit including a bias circuit (1) generating a signal reflecting a current driving capability of a transistor; an analog/digital converter circuit (2) converting the signal from an analog format into a digital format; and a signal processing circuit (3) partially controlled in an operating state or a non-operating state according to the signal converted by the analog/digital converter circuit as a control signal, is provided.

12 Claims, 5 Drawing Sheets

SEMICONDUCTOR CIRCUIT AND CONTROLLING METHOD THEREOF

CROSS-REFERENCE TO RELATED APPLICATION

This application is a National Stage entry of International Application No. PCT/JP2005/22488 filed Dec. 7, 2005. The disclosure of the prior application is hereby incorporated herein in its entirety by reference.

TECHNICAL FIELD

The present invention relates to a semiconductor circuit and its controlling method.

BACKGROUND ART

The analog circuit in a system LSI is increasing in importance. In order to realize the analog circuit in a CMOS process, countermeasures against variations in transistor manufacture during the manufacturing processes of semiconductors and the variations in transistor characteristics dependent on the ambient temperature during operation are a significant challenge. For instance, the drain current Id and the transconductance gm of a transistor vary due to dispersion of the oxide film thickness during manufacturing processes and in the width of polysilicon or the like even when the same driving voltage is given, and vary due to ambient temperatures. Due to these variations, problems arise from variations in operating speed or current consumption of analog circuits.

Japanese Patent Application Laid-Open No. Sho 61-114319 describes an MOS analog integrated circuit including n-pieces (plural) analog circuit blocks; n-pieces (plural) bias circuit blocks supplying biases corresponding with the n-pieces analog circuit blocks while receiving a common controlling signal; and a control circuit outputting the common controlling signal to the n-pieces bias circuit blocks.

Japanese Patent Application Laid-Open No. Hei 8-321584 describes a semiconductor integrated circuit having a differential amplifier that receives an internal signal center voltage into one of input terminals as a reference voltage, because when the threshold value of a MOSFET composing a circuit varies due to variations during the manufacture or variations in ambient temperature, the internal signal center voltage also varies in the same fashion.

Japanese Patent Application Laid-Open No. 2003-150258 describes a bias voltage generation circuit, which supplies a bias voltage at low power supply voltage and in a wide-power supply voltage range, and is able to realize reduction in consumption power and to reduce the influence of variations in manufacturing process and variations in temperature conditions during the operation.

SUMMARY OF THE INVENTION

According to an aspect of the present invention, a semiconductor circuit including a bias circuit generating a signal reflecting a current driving capability of a transistor, an analog/digital converter circuit converting the signal from an analog format into a digital format, and a signal processing circuit partially controlled in an operating state or a non-operating state according to the signal converted by the analog/digital converter circuit as a control signal is provided.

DETAILED DESCRIPTION OF THE PREFERRED EMBODIMENTS

Figure 1:
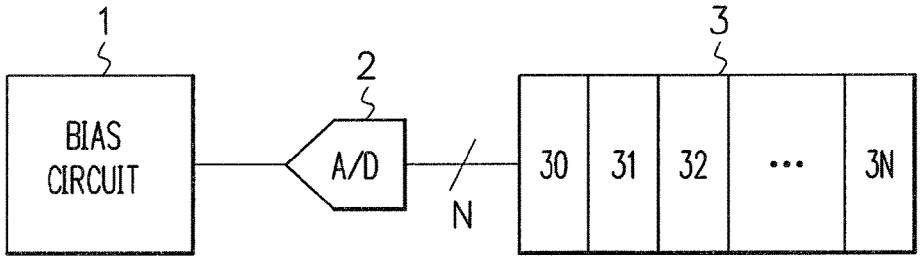
FIG. 1 is a block diagram showing a configuration example of a semiconductor circuit according to a first embodiment of the present invention.

Hereinafter, a MOS field effect transistor will be simply referred to as a transistor. The drain current Id and the transconductance gm of the transistor are given by the following equations (1) and (2).

$$Id=(\beta/2)\times Vod^2 \quad (1)$$

$$gm=\beta\times Vod \quad (2)$$

Here, however, Vod is a driving voltage of the transistor Vod=Vgs−Vth, where the voltage between the gate and the source of the transistor is Vgs, and the threshold voltage of the transistor is Vth. The "β" is a coefficient of the transistor, which is proportional to the channel width W and inversely proportional to the channel length L of the transistor. In addition, the coefficient β and the threshold voltage Vth vary depending on process conditions and temperatures.

The variations in the threshold voltage Vth enables to keep the driving voltage Vod of a transistor at a fixed value without depending on the threshold voltage Vth by using a bias method to control the circuit current without depending on the threshold voltage Vth like a current mirror, for instance, so that it is possible to reduce the influence given to the drain current Id and the transconductance gm of the transistor by the variations in the threshold voltage Vth.

Meanwhile, as for the variations in the coefficient β, since it works as a coefficient of the drain current Id and the transconductance gm, in order to keep the drain current Id or the transconductance gm at a fixed value, it is necessary to perform control such that the driving voltage Vod varies according to the variations in the coefficient β. In such a case, since characteristics which strongly depend on the driving voltage Vod among the characteristics of the transistor such as noise or matching characteristic vary according to process conditions and temperatures, it becomes necessary to design a circuit having a margin for the variations in characteristics considering these characteristics additionally. In contrast, when the transistor is controlled in a bias state so that the driving voltage Vod is kept at a fixed value, the drain current Id and the transconductance gm vary according to the variations in the coefficient β, which results in variations in power consumption and the operating speed of the circuit.

Then, it is possible to conceive of a bias circuit that generates a drain current Id which keeps the transconductance gm of the transistor at a fixed value so as to keep the operating speed of the circuit at a fixed value against the variations in the coefficient β due to process conditions and temperatures. In such a case, however, the drain current Id and the driving voltage Vod vary according to variations in the coefficient β. Further, when a bias circuit, which makes the drain current Id a fixed value is used, the transconductance gm and the driving voltage Vod of the transistor vary for the variations in the coefficient β due to process conditions and temperatures.

In the bias method, it is difficult to simultaneously control the transconductance gm, the drain current Id and the driving voltage Vod to be at fixed value against the variations in process conditions and temperatures. Accordingly, when designing a circuit, considering the variations in characteristics of the transistor, it is necessary to prepare a margin for the variations in process conditions and temperatures. Then difficulty in designing increases and, at the same time, high performance of the circuit is hindered.

Embodiments of the present invention realize a semiconductor circuit that can automatically keep the current consumption, the operating speed and the driving voltage of a circuit at fixed values irrespective of manufacturing variations in characteristic of a transistor and/or in temperatures.

First Embodiment

FIG. 1 is a block diagram showing a configuration example of a semiconductor circuit according to the first embodiment of the present invention. Circuit 1 is a bias circuit and generates a voltage signal or a current signal reflecting the current driving capability of a transistor. Circuit 2 is an analog/digital converter circuit, and converts the signal generated by the bias circuit 1 from an analog format to a digital format at an optional accuracy so that an N-bit digital signal is outputted to circuit 3 as a control signal. The circuit 3 is a signal processing circuit actually conducting signal processing, a part of or a whole of the circuit has a parallel connection structure, and is composed of element circuits 30 to 3N, which are partially controlled in an operating state or a non-operating state according to a control signal, respectively. In the parallel connection structure, an optional number of element circuits 30 to 3N can be connected in parallel, the size of the circuit of the respective element circuits 30 to 3N is not necessarily required to be equal, and the circuits can be structured at any circuit size ratios. For instance, the signal processing circuit 3 is composed of N+1 pieces of the element circuits 30 to 3N. The element circuit 30 is always in an operating state. The element circuits 31 to 3N are provided for every control signal in N bit respectively, and are controlled in an operating state or a non-operating state according to an N-bit control signal.

Figure 2:
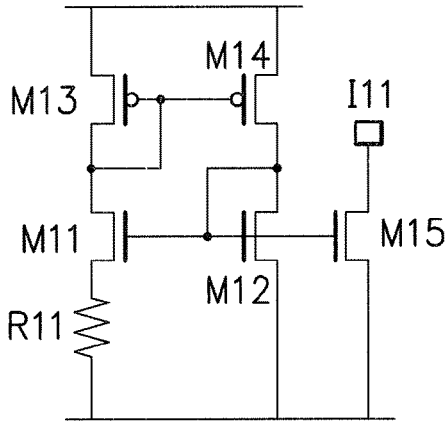
FIG. 2 is a circuit diagram showing a configuration example of a bias circuit in FIG. 1.

FIG. 2 is a circuit diagram showing a configuration example of the bias circuit 1 in FIG. 1. In a p-channel transistor M13, a source is connected to a supply source voltage, and a gate and a drain are connected to a drain of an n-channel transistor M11. In the n-channel transistor M11, the gate is connected to the gate and the drain of an n-channel transistor M12, and the source is connected to a ground via a resistor R11. In a p-channel transistor M14, the gate is connected to the gate and the drain of the transistor M13, the source is connected to the supply source voltage, and the drain is connected to the gate and the drain of the transistor M12. The source of the transistor M12 is connected to the ground. In an n-channel transistor M15, the gate is connected to the gates of the transistors M11 and M12, the source is connected to the ground and the drain is connected to a current terminal I11.

For instance, the channel width of the transistor M11 is four times the channel width of the transistor M12, and the channel widths of the transistors M13 and M14 are equal to each other. At this time, the transconductance gm of the transistor M12 is associated with a resistance value of the resistor R11 and is controlled to a fixed value irrespective of process conditions and temperatures. At this time, the drain current Id of the transistor M12 is copied with the transistor M15 by a current mirror and is outputted to the terminal I11. For the resistor R11, for instance, a resistor element outside the semiconductor chip, which is not susceptible to the influence of process conditions and temperatures, is used.

At this time, since an output current of the terminal I11 of the bias circuit is a current to control the mutual inductance gm of the transistor at a fixed value, the driving voltage Vod of the transistor is controlled to be inversely proportional to the variations in the coefficient β from the equation (2) above. When the above equation (2) is transformed into the next equation (3), and by substituting the equation (3) into the above equation (1), the following equation (4) can be obtained.

$$Vod=gm/\beta \tag{3}$$

$$Id=gm^2/(2\times\beta) \tag{4}$$

From the equation (4), assuming that the transconductance gm is a fixed value, it is clear that the drain current Id is inversely proportional to the variations in the coefficient β. The transistors M11, M12 and M15 compose a current mirror. The output current of the terminal I11 is inversely proportional to the variations in the coefficient β of the transistor and can be used as a current signal reflecting the variations in the coefficient β. This bias circuit generates a current signal, which is controlled so that the transconductance gm of the transistor is to be a fixed value, at the terminal I11.

Figure 3:
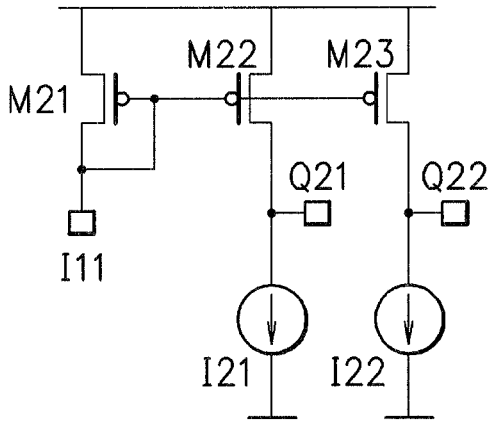
FIG. 3 is a circuit diagram showing a configuration example of an analog/digital converter circuit in FIG. 1.

FIG. 3 is a circuit diagram showing a configuration example of the analog/digital converter circuit 2 in FIG. 1. In a p-channel transistor M21, the source is connected to the supply source voltage, and the gate and the drain are connected to the terminal I11. In a p-channel M22, the gate is connected to the gate and the drain of the transistor M21, the source is connected to the supply source voltage, and the drain is connected to a terminal Q21. A current source I21 is connected between the terminal Q21 and the ground. In a p-channel transistor M23, the gate is connected to the gates of the transistors M21 and M22, the source is connected to the supply source voltage, and the drain is connected to a terminal Q22. A current source I22 is connected between the terminal Q22 and the ground. The transistors M21, M22 and M23 compose a current mirror.

The current of the current output terminal I11 of the bias circuit 1 in FIG. 2 is copied by the current mirror composed of the transistors M21, M22 and M23, compared with the reference current sources I21 and I22, and a control signal is outputted from the output terminals Q21 and Q22. When the output current of the terminal I11 of the bias circuit 1 is greater than the current of the reference current source I21, the control signal of the terminal Q21 is at a high level, and when it is smaller, the control signal of the terminal Q21 is at a low level. When the output current of the terminal I11 of the bias circuit 1 is greater than the current of the reference current source I22, the control signal of the terminal Q22 is at a high level, and when it is smaller, the control signal of the terminal Q22 is at a low level. This example is the resolution of 3 values. By setting respective currents of the reference current sources I21 and I22 appropriately, it is possible to determine the current of the terminal I11 to be at three levels.

Hereinafter, the current of the terminal I11, the reference current sources I21 and I22 will be explained as I11, I21 and I22 respectively. For instance, assuming that I21<I22, when I11 is smaller than I21, both terminals Q21 and Q22 output at a low level. For cases where I21<I11<I22, the terminal Q21 outputs at a high level, the terminal Q22 outputs at a low level. For cases where I22<I11, both terminals Q21 and Q22 output at a high level. The analog/digital converter circuit 2 converts an analog signal of the terminal I11 into a two-bit digital signal of the terminals Q21 and Q22. In order to prevent a phenomenon of unstable outputting due to the influence of noise, a low-pass filter or a Schmitt trigger gate may be inserted into the output terminals Q21 and Q22.

For instance, when the current of the terminal I11 is at the average state of variations in process conditions and temperatures, in other words, in the most average state is estimated at I0, and if the current of the reference current source I21 is set to be 0.75×I0, the current of the reference current source I22 is set to be 1.25×I0 for instance, the terminal Q21 outputs at a high level and the terminal Q22 outputs at a low level in the case where the current of the terminal I11 is at an average. When the current of the terminal I11 is comparatively small, the terminals Q21 and Q22 output at a low level. When the current of the terminal I11 is comparatively large, the terminals Q21 and Q22 output at a high level. In other words, the number of signals at a high level out of the signals of the terminals Q21 and Q22 is within the range of 0 to 2, which means that it reflects the magnitude of the current signal of the terminal I11.

Figure 4:
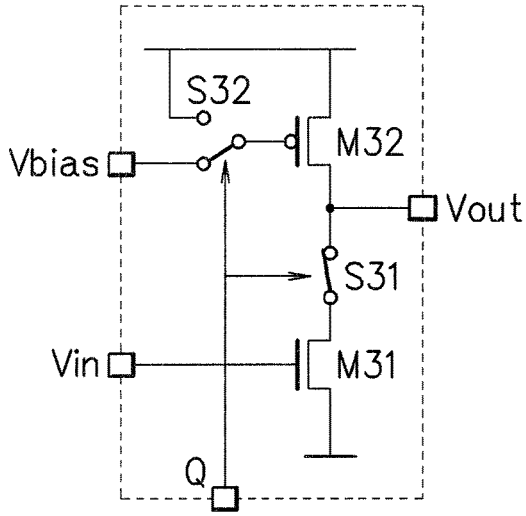
FIG. 4 is a circuit diagram showing a configuration example of an element circuit in FIG. 1.

FIG. 4 is a circuit diagram showing each configuration example of the element circuits 30 to 3N in FIG. 1. In a p-channel transistor M32, the gate is connected to a switch S32, the source is connected to the supply source voltage and the drain is connected to an output terminal Vout. In an n-channel transistor M31, the gate is connected to an input terminal Vin, the drain is connected to the output terminal Vout via a switch S31 and the source is connected to the ground. A terminal Q is connected to the terminals Q21 or Q22 in FIG. 3. The switch S31 closes when the terminal Q is at a high level, and opens when the terminal Q is at a low level. The switch S32 connects a bias terminal Vbias to the gate of the transistor M32 to make the transistor M32 on when the terminal Q is at a high level, and connects the supply source voltage to the gate of the transistor M32 to turn the transistor M32 off when the terminal Q is at a low level. The bias voltage or the bias current is supplied to the bias terminal Vbias.

The element circuits 30 to 3N are a source grounding amplifier (amplification circuit), it amplifies input voltage of the input terminal Vin and outputs output voltage from the output terminal Vout. The n-channel transistor M31 is an input transistor, and the p-channel transistor M32 is a transistor for supplying a bias current. The source grounding amplifier changes to an operating state or a non-operating state by the switches S31 and S32. The state in the drawing shows an operating state, and the switches S31 and 32 are switched onto a different state respectively in a non-operating state. The switches S31 and S32 are controlled by a control signal of the terminal Q. Here, when the terminal Q is in a high level state, the operating state shown in the drawing is realized, and a non-operating state is realized when the terminal Q is at a low level. Actually, the switches S31 and S32 can be configured with transistors.

Figure 5:
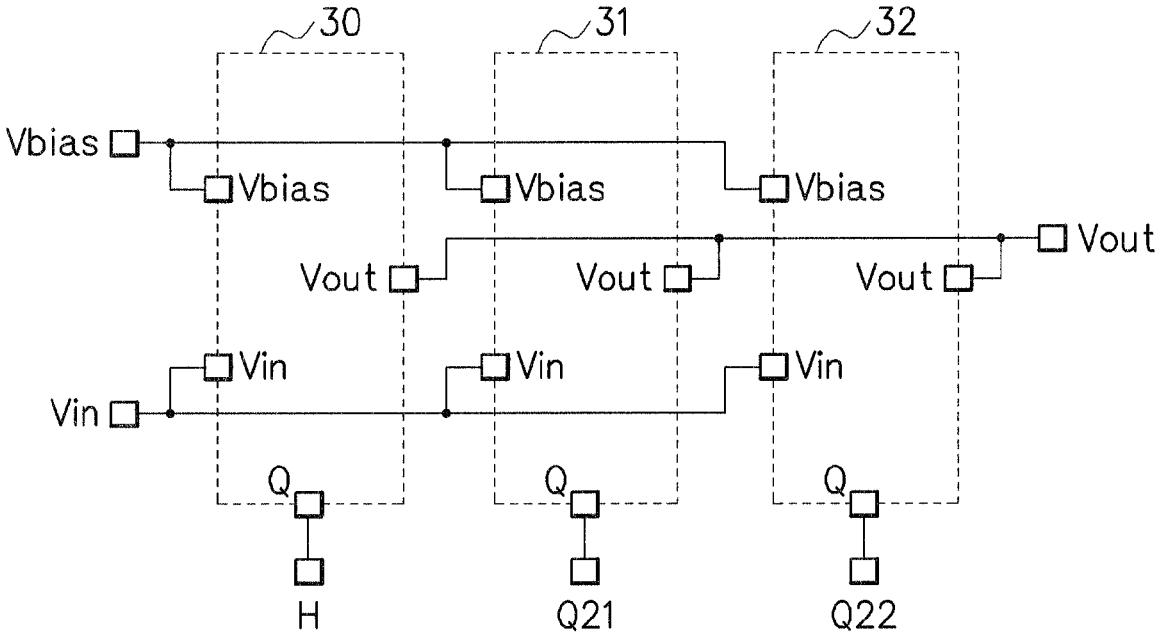
FIG. 5 is a view showing a configuration example of a signal processing circuit in FIG. 1.

FIG. 5 is a view showing a configuration example of the signal processing circuit 3 in FIG. 1. The signal processing circuit 3 has a parallel connection structure composed of three element circuits 30, 31 and 32. The element circuits 30, 31 and 32 include a circuit configuration in FIG. 4 respectively. The input terminals Vin and the output terminals Vout are connected respectively in the element circuits 30 to 32. The terminal Q 21 in FIG. 3 is connected to the control terminal Q of the element circuit 31. The terminal Q22 in FIG. 3 is connected to the control terminal Q of the element circuit 32. The element circuits 31 and 32 are controlled in an operating state or in a non-operating state according to control signals of the control terminals Q21 and Q22 respectively. A high level state is always given to the control terminal Q of the element circuit 30, and the element circuit 30 is always in an operating state irrespective of signals of the control terminal Q21 and Q22.

At this time, the number of the element circuits 30 to 32 set in an operating state by the control terminals Q21 and Q22 at a high level is controlled within the range of 1 to 3 according to the number of the control terminals Q21 and Q22 at a high level. As described above, the circuit size of the signal processing circuit 3 is controlled according to the number at a high level reflecting the magnitude of the output current of the bias circuit 1. It is possible to make the circuit size of the signal processing circuit 3 in a operating state proportional to the output current of the bias circuit 1 by resolution with 3 values. Since the output current of the bias circuit 1 is inversely proportional to the variations in the coefficient β of the transistor, although the circuit size of the signal processing circuit 3 in an operating state is inversely proportional to the variations in the coefficient β similarly, a practically effective coefficient β of the signal processing circuit 3 expressed by the product of the channel width and the number of the transistors in an operating state, and the product of β is kept at a fixed value irrespective of process conditions and temperatures.

The bias circuit 1 generates a current signal to control the transconductance gm of the transistor to be a fixed value. The analog/digital converter circuit 2 converts the current signal generated by the bias circuit 1 into a discrete value at an optional accuracy. The signal processing circuit 3 is controlled in its circuit size such that the total of the product of the channel width and the number of the element circuits 30 to 3N kept in an operating state among the element circuits 30 to 3N having parallel connection structures is proportional to the current signal of the bias circuit 1.

The signal processing circuit 3 receives the control signals of the control terminals Q21 and Q22. The element circuits 31 and 32 are kept in an operating state when the control terminals Q21 and Q22 are at a high level respectively, and are kept in a non-operating state when at a low level. When the current of the terminal I11 is high, the size of the circuit in an operating state can be made large, and when the current of the terminal I11 is low, the size of the circuit in an operating state can be made small. Thus, the circuit size can be controlled to be proportional to the current signal of the terminal I11.

The relation between the coefficient β and the channel width W will be explained next. The coefficient β is expressed by the following equation (5). Here, μ is mobility, Cox is the capacity of a gate oxide film, W is a channel width, and L is a channel length.

$$\beta=\mu\times Cox\times W/L \quad (5)$$

Since the transconductance gm of the bias circuit 1 is a fixed value in the bias circuit 1, when the coefficient β becomes small, the current of the terminal I11 is high from the above equation (4). In the signal processing circuit 3, when the current of the terminal I11 becomes high, the number of the transistors kept in an operating state increases. This means that there is an increase in the channel width W of the transistor, and means that the coefficient β increases from the equation (5). This control makes it possible to keep an effective coefficient β at a fixed value.

In contrast, in the bias circuit 1, when the coefficient β becomes large, the current of the terminal I11 is low. In the signal processing circuit 3, when the current of the terminal I11 becomes low, the number of the transistors kept in an operating state decreases. This means that there is a decrease in the channel width W of the transistor, and means that the coefficient β decreases from the equation (5). This control makes it possible to keep an effective coefficient β at a fixed value.

The signal processing circuit 3 is capable of controlling the total of circuit size of the element circuits 30 to 3N in an operating state to be inversely proportional to the value of the coefficient β which is varied according to process conditions and temperatures. Since the coefficient β is a value proportional to the product of the channel width W and the number of the transistors, the total of the coefficient β for the element circuits 30 to 3N in an operating state, in other words, the effective coefficient β of the signal processing circuit 3 is proportional to the total of the product of the channel width and the number of the transistors of the element circuits 30 to 3N in an operating state. Accordingly, by controlling the circuit size of the element circuits 30 to 3N in an operating state to be inversely proportional to the value of the varying coefficient β, it is possible to keep the effective coefficient β of the signal processing circuit 3 at a fixed value. Simultaneously, by supplying current of fixed magnitude to the terminal Vbias of the element circuits 30 to 3N of the signal processing circuit 3 in an operating condition, it is possible to keep the effective drain current Id, the transconductance gm, and the driving voltage Vod of the signal processing circuit 3 at fixed values irrespective of process conditions and temperatures.

Figure 9:
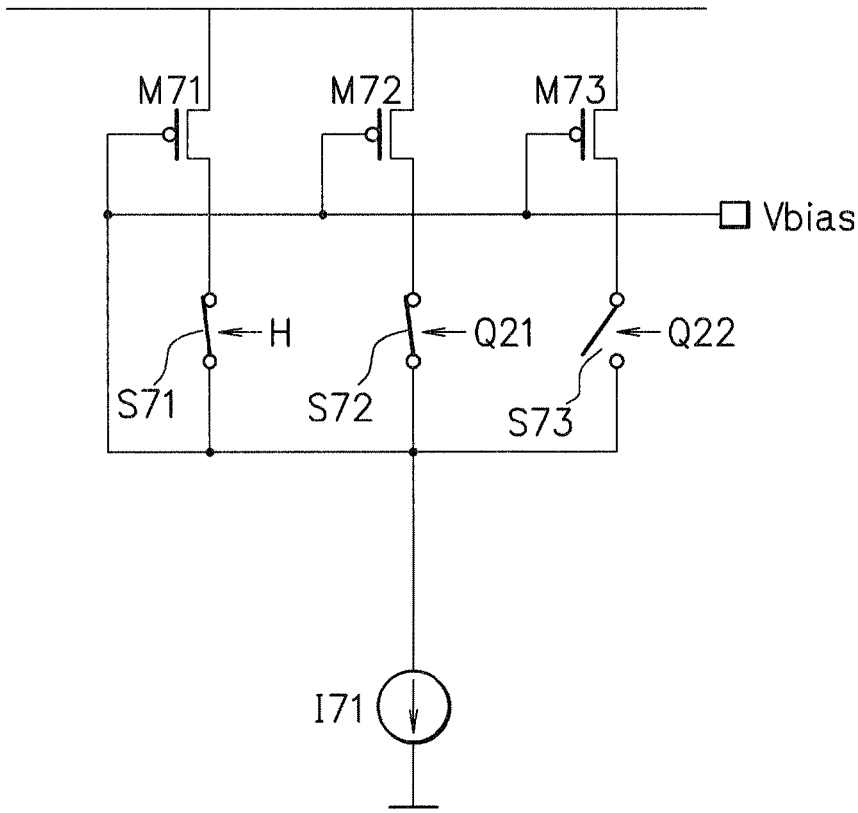
FIG. 9 is a circuit diagram showing the configuration example of a circuit for supplying current of fixed magnitude to the configuration example of the signal processing circuit in FIG. 5.

FIG. 9 is a circuit diagram showing the configuration example of a circuit for supplying current of fixed magnitude to the configuration example of the signal processing circuit in FIG. 5. In a p-channel transistor M71, the gate is connected to the terminal Vbias, the source is connected to the supply source voltage and the drain is connected to the terminal Vbias via a switch S71. In a p-channel transistor M72, the gate is connected to the gate of the transistor M71, the source is connected to the supply source voltage and the drain is connected to the terminal Vbias via a switch S72. In a p-channel transistor M73, the gate is connected to the gates of the transistors M71 and M72, the source is connected to the supply source voltage and the drain is connected to the terminal Vbias via a switch S73. A fixed current source I71 is connected between the terminal Vbias and the ground. The switch S71, into which a high level signal is inputted as a control signal, is always closed similarly to the switch S31 of the element circuit 30. The switch S72, into which a signal of the terminal Q21 is inputted as a control signal, behaves similarly to the switch S31 of the element circuit 31. The switch S73, into which a signal of the terminal Q22 is inputted as a control signal, behaves similarly to the switch S31 of the element circuit 32. In other words, the switches S71 to S73 behave similarly to the switch S31 of the element circuits 30 to 32 respectively. The transistors M71 to M73 configure a current mirror together with the transistor M32 of the element circuits 30 to 32. By taking this configuration, current of fixed magnitude can be supplied to the configuration example of the signal processing circuit in FIG. 5.

The signal processing circuit 3 configures a current mirror, with which a plurality of element circuits 30 to 32 copy current according to the reference current. The current mirror includes the first element circuit 30 being in an operating state irrespective of signals of the control terminals Q21 and Q22, and the second element circuits 31 and 32 which take an operating state or a non-operating state according to signals of the control terminals Q21 and Q22. The reference current of the current mirror of the terminal Vbias is current of fixed magnitude.

In the signal processing circuit 3, since the element circuits 31 and 32 which are controllable in an operating state among the parallel connection structures are controlled according to the control signals of terminals such as the above-described terminals Q21 and Q22, it is possible to keep the total current of the element circuits 30 to 32 in an operating state at fixed magnitude irrespective of process conditions and temperatures.

Figure 8:
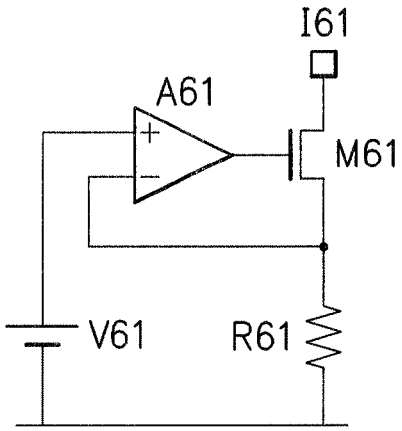
FIG. 8 is a circuit diagram showing a configuration example of a current source of fixed magnitude in FIG. 3 and FIG. 9.

FIG. 8 is a circuit diagram showing respective configuration examples of the fixed current sources I21, I22 and I71 in FIG. 3 and FIG. 9. In a differential amplifier A61, an inverse input terminal is connected to the ground via a resistor R61, a non-inverse input terminal is connected to the ground via a voltage source V61, and the output terminal is connected to the gate of an n-channel transistor M61. In the n-channel transistor M61, the source is connected to the non-inverse input terminal of the differential amplifier A61, and the drain is connected to a current output terminal I61.

A negative feedback system is configured so that the voltage of the inverse input terminal is equal to the voltage of the voltage source V61 by the function of the differential amplifier A61. The current flowing through the resistor R61 is controlled by V61/R61. Since this current is common to the current of the n-channel transistor M61, the current taken out from the current output terminal I61 is also controlled by V61/R61.

As described above, since the output current of the terminal I61 is determined by the voltage source V61 and the resistor R61, it is possible to generate current of fixed magnitude by designing the voltage value shown by the voltage source V61 and the resistance value shown by the resistor R61 so that they are not to be influenced by manufacturing variations and temperatures. Actually, it is possible to use the output voltage of the band gap reference circuit as the voltage source V61. In addition, it is possible to use a resistance element outside of the semiconductor chip, which is not likely to be influenced by manufacturing variations and temperatures as the resistor R61.

It is possible to copy the output current of the terminal I61 formed by the configuration described above at an optional magnification in an optional number by a current mirror or the like. This current can be used as the reference current source I71 in FIG. 9 and the reference current sources I21 and I22 in FIG. 3.

Second Embodiment

Figure 6:
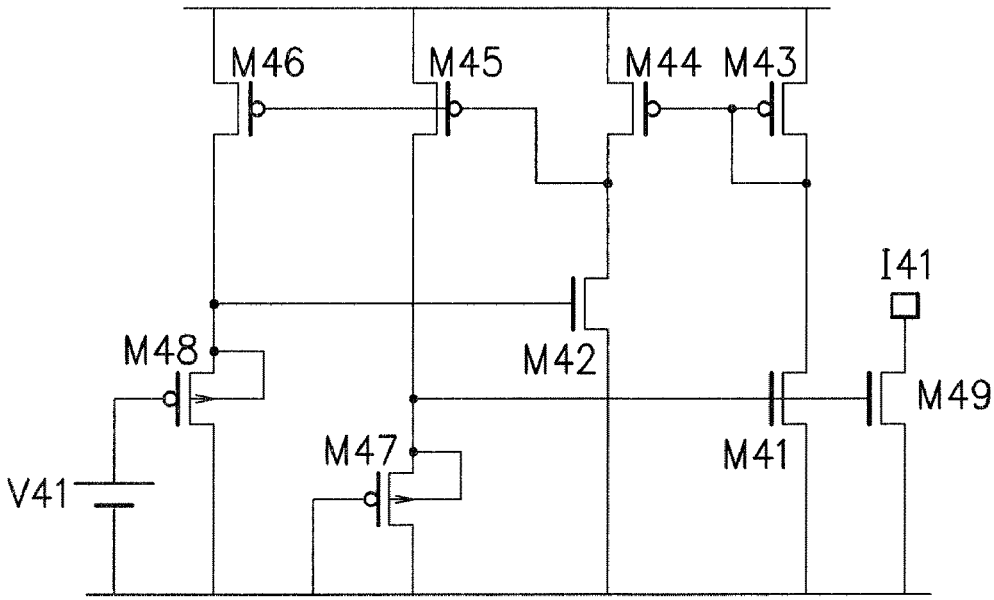
FIG. 6 is a circuit diagram showing a configuration example of a bias circuit according to a second embodiment of the present invention.

FIG. 6 is a circuit diagram showing the configuration example of the bias circuit 1 according to the second embodiment of the present invention. The analog/digital converter circuit 2 and the signal processing circuit 3 are the same as those in the first embodiment. Hereinafter, the different points in the present embodiment from the first embodiment will be explained.

The configuration of the bias circuit 1 will be explained with reference to FIG. 6. The gates of p-channel transistors M45 and M46 are connected to the drain of a p-channel transistor M44. The gates of p-channel transistors M43 and M44 are connected to the drain of the transistor M43. The sources of the transistors M43 to M46 are connected to the supply source voltage. In a p-channel transistor M48, the gate is connected to the ground via a voltage source V41, the source is connected to the drain of the transistor M46, and the drain is connected to the ground. In a p-channel transistor M47, the gate and the drain are connected to the ground, and the source is connected to the drain of the transistor M45. In an n-channel transistor M42, the gate is connected to the drain of the transistor M46, the drain is connected to the drain of the transistor M44, and the source is connected to the ground. In n-channel transistors M41 and M49, the gate is connected to the drain of the transistor M45 and the source is connected to the ground. The drain of the transistor M41 is connected to the drain of the transistor M43. The drain of the transistor M49 is connected to the current terminal I41.

It is possible to configure, for instance, the channel width of the n-channel transistor M41 with four times the channel width of the transistor M42, and make the channel width of other p-channel transistors M43 to M48 equal to each other. The transistors M43 and M44 configure a current mirror, and the transistors M45 and M47, the transistors M46 and M48 configure a source and a follower. The gate of the transistor M48 is given a voltage of the voltage source V41, and the gate of the transistor M47 is grounded.

At this time, the driving voltage Vod of the transistor M41 is associated with the voltage of the voltage source V41 to be given to the gate of the transistor M48, and is controlled at a fixed driving voltage Vod irrespective of process conditions and temperatures. The drain current of the transistor M41 at this time is copied with the transistor M49 and outputted to the terminal I41.

At this time, since the output current of the terminal I41 of the bias circuit 1 is the current to keep the driving voltage Vod of the transistor at a fixed value, it is clear from the above equation (1) that the drain current Id is proportional to the variations in the coefficient β. Accordingly, the output current of the terminal I41 is proportional to the variation in the coefficient β of the transistor, and can be used as a current signal reflecting the variations in the coefficient β.

The analog/digital converter circuit 2 of this embodiment can be composed of the circuit in FIG. 3 similarly to the analog/digital converter circuit 2 in the first embodiment. The current of the current output terminal I41 of the bias circuit 1 in FIG. 6 is connected to the current input terminal I11 in FIG. 3 to output a control signal to the control terminals Q21 and Q22 with the same operating principle explained already. In other words, assuming the case of I21<I22 for instance, in the case of I41<I22, both terminals Q21 and Q22 output a signal at a low level. In the cases of I21<I41<I22, the terminal Q21 outputs a signal at a high level, and the terminal Q22 outputs a signal at a low level. In the case of I22<I41, both terminals Q21 and Q22 output a signal at a high level.

Accordingly, the number of signals at a high level out of the control terminals Q21 and Q22 reflects the magnitude of the current signal of the terminal I41 within the range of 0 to 2. Accordingly, the following configuration will work successfully. That is: the signal processing circuit 3 receives the signals of these two control terminals Q21 and Q22, and the element circuits 31 and 32 receiving the respective signals are kept in a non-operating state when the signals of the control terminals Q21 and Q22 are at a high level, and are kept in an operating state when the signals of the control terminals Q21 and Q22 are at a low level. In other words, it is required in the embodiment that the switches S31 and S32 of the element circuit in FIG. 4 behave oppositely for respective cases of the control terminal Q is at a high level and at a low level. By this configuration, when the current of the terminal I41 is high, the size of the current in an operating state can be made small, and when the current at the terminal I41 is small, the size of the current in an operating state can be made large, so that the size of the circuit can be controlled to be inversely proportional to the current signal.

In the bias circuit 1, since the driving voltage Vod has a fixed value, when the coefficient β becomes small, the current of the terminal I11 is high from the above equation (1). In the signal processing circuit 3, when the current of the terminal I41 becomes low, the number of the transistors kept in an operating state increases. This means that there is an increase in the channel width W of the transistor, and means that the coefficient β increases from the equation (5). This control makes it possible to keep an effective coefficient β at a fixed value.

In contrast, in the bias circuit 1, when the coefficient β becomes large, the current of the terminal I11 is low. In the signal processing circuit 3, when the current of the terminal I11 becomes high, the number of the transistors kept in an operating state decreases. This means that there is a decrease in the channel width W of the transistor, and means that the coefficient β decreases from the above equation (5). This control makes it possible to keep an effective coefficient β at a fixed value.

Simultaneously by supplying a current of fixed magnitude to the terminal Vbias of the element circuits 30 to 3N of the signal processing circuit 3 in an operating state, it is possible to keep the effective drain current Id, the transconductance gm and the driving voltage Vod of the signal processing circuit 3 at fixed values irrespective of process conditions and temperatures.

According to the present embodiment, the bias circuit 1 generates a current signal controlled such that the driving voltage Vod of the transistor is to have a fixed value. The analog/digital converter circuit 2 converts the current signal generated by the bias circuit 1 into a discrete value at an optional accuracy. The signal processing circuit 3 controls the circuit size thereof in the manner so that the total of the products of the channel width and the number of transistors of the element circuit controlled in an operating state among the element circuits 30 to 32 composing the parallel connecting structure is inversely proportional to the current signal of the bias circuit 1.

Third Embodiment

Figure 7:
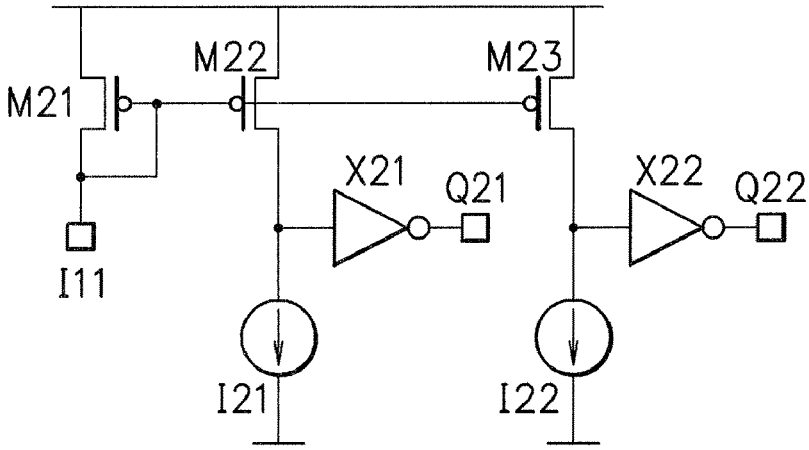
FIG. 7 is a circuit diagram showing a configuration example of an analog/digital converter circuit according to a third embodiment of the present invention.

FIG. 7 is a circuit diagram showing a configuration example of the analog/digital converter circuit 2 according to the third embodiment of the present invention. The bias circuit 1 and the signal processing circuit 3 are the same as those in the second embodiment. The points of the present embodiment different from the second embodiment will be explained below.

The analog/digital converter circuit 2 in FIG. 7 is addition of inverters X21 and X22 to the analog/digital converter circuit 2 in FIG. 3. The inverter X21 is connected between the terminal Q21 and the drain of the transistor M22. The inverter X22 is connected between the terminal Q22 and the drain of the transistor M23. The terminal I11 is connected to the terminal I41 in FIG. 6. The analog/digital converter circuit 2 in FIG. 7 is an example of a circuit which outputs signals of the output terminals Q21 and Q22 of the analog/digital converter circuit 2 in FIG. 3 by inverting the signals.

In the circuit in FIG. 7, similarly to the circuit in FIG. 3, a low-pass filter or a Schmitt trigger gate may be inserted to the inputs of the inverters X21 and X22 or the terminals Q21 and Q22 for the purpose of preventing a phenomenon that the output becomes unstable due to the influence of noises.

For instance, assuming that I21 is lower than I22, in the cases of I41<I21, both terminals Q21 and Q22 output signals at a high level. In the case of I21<I41<I22, the terminal Q21 outputs a signal at a low level, and the terminal Q22 outputs a signal at a high level. In the case of I22<I41, both terminals Q21 and Q22 output signals at a low level.

At this time, the number of signals at a low level between the control terminals Q21 and Q22 is within the range of 0 to 2, which reflects the magnitude of the current signal of the terminal I41. The signal processing circuit 3 receives signals of two control terminals Q21 and Q22, similarly to the first embodiment, and the element circuits 21 and 22 which receive the signals respectively are kept in an operating state when the control terminals Q21 and Q22 are at a high level and are kept in a non-operating state when the control terminals are at a low level. By this configuration, when the current of the terminal I41 is high, the size of the current in an operating state can be made small, and when the current at the terminal I41 is small, the size of the current in an operating state can be made large, so that the size of the circuit can be controlled to be inversely proportional to the current signal.

Fourth Embodiment

Figure 10:
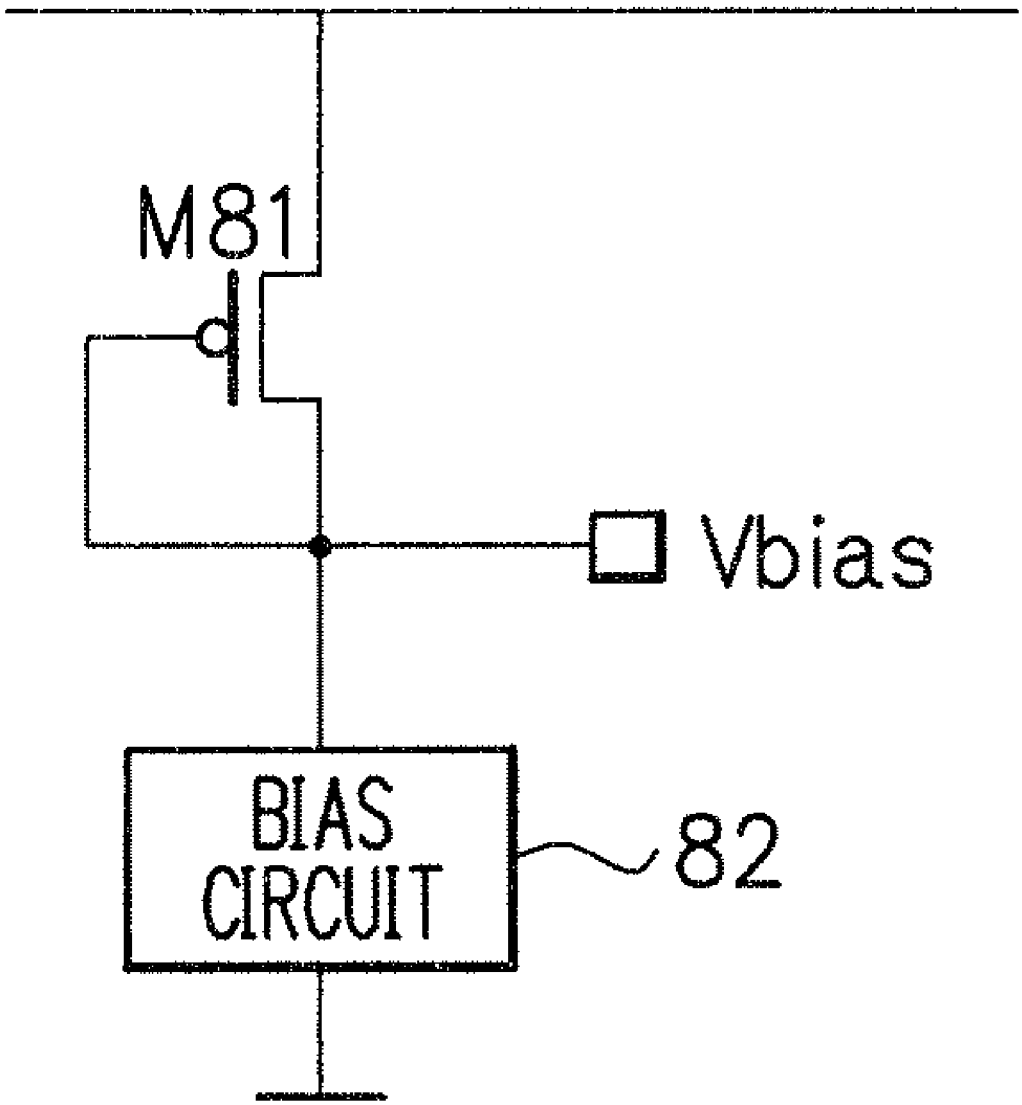
FIG. 10 is a circuit diagram showing a configuration example of a circuit for supplying current to the configuration example of the signal processing circuit in FIG. 5 according to a fourth embodiment of the present invention.

FIG. 10 is a circuit diagram showing a configuration example of a circuit for supplying current to the configuration example of the signal processing circuit in FIG. 5 according to the fourth embodiment of the present invention. The terminal Vbias can be connected to a circuit in FIG. 10 instead of the circuit in FIG. 9.

In a p-channel transistor M81, the source is connected to the supply source voltage, and the gate and the drain are connected to the terminal Vbias and a bias circuit 82. The bias circuit 82 is configured similarly to the bias circuit in FIG. 6. The terminal I41 of the bias circuit 82 is connected to the terminal Vbias and the transistor M81.

By supplying the bias current to the terminal I41 in such a manner that the transistor of the signal processing circuit 3 develops a current density similar to the transistor M41 based on an output current from the terminal I41 of the bias circuit 82, the transistor of the signal processing circuit 3 can be controlled to a driving voltage Vod of fixed magnitude.

The signal processing circuit 3 composes a current mirror through which a plurality of element circuits 30 to 32 copy current according to the reference current. The current mirror includes the first element circuit 30, which is in an operating state irrespective of signals of the control terminals Q21 and Q22, and the second element circuits 31 and 32 which are in an operating state or a non-operating state according to signals of the control terminals Q21 and Q22. The reference current of the current mirror of the terminal Vbias is a current proportional to a current signal controlled in a manner that the driving voltage Vod of the transistor is at a fixed value.

The signal processing circuit 3 can control the total current of the element circuits in an operating state at a fixed value irrespective of process conditions and temperatures by controlling the operating state of the element circuits 30 to 32 similarly to the first to third embodiments.

As described above, according to the first to fourth embodiments, the transistor circuit includes the bias circuit 1 generating a control signal reflecting the speed of the manufactured transistor. The signal processing circuit 3 has a parallel connection structure, and the respective element circuits 30 to 3N are controlled to an operating state or a non-operating state individually by a control signal. Then, it becomes possible to automatically keep the current consumption, the operating speed and the driving voltage of the circuit at fixed values irrespective of manufacturing variations and temperatures of transistor characteristics.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

INDUSTRIAL APPLICABILITY

By controlling an operating state or a non-operating state according to the current driving capability of transistors, it becomes possible to automatically keep the current consumption, the operating speed and the driving voltage of the circuit at fixed values irrespective of manufacturing variations and/or temperatures of transistor characteristics.

What is claimed is:

1. A semiconductor circuit, comprising:

a bias circuit having a transistor and generating a signal reflecting a current driving capability of the transistor;

an analog/digital converter circuit converting the signal from an analog format into a digital format; and a signal processing circuit partially controlled in an operating state or a non-operating state according to the signal converted by said analog/digital converter circuit as a control signal, wherein said signal processing circuit is configured in such a manner that a plurality of element circuits controlled partially in an operating state or a non-operating state are connected in parallel, wherein said bias circuit generates a current signal controlled in such a manner that transconductance of the transistor is a certain fixed value; and wherein the total of the product of the channel width and the number of transistors of the element circuits controlled in the operating state in said signal processing circuit is proportional to the current signal.

2. The semiconductor circuit according to claim 1, wherein the signal generated by said bias circuit is a voltage signal or a current signal.

3. The semiconductor circuit according to claim 1, wherein the current signal is inversely proportional to a coefficient β of the transistor.

4. A semiconductor circuit, comprising:

a bias circuit having a transistor and generating a signal reflecting a current driving capability of the transistor;

an analog/digital converter circuit converting the signal from an analog format into a digital format; and a signal processing circuit partially controlled in an operating state or a non-operating state according to the signal converted by said analog/digital converter circuit as a control signal, wherein said signal processing circuit is configured in such a manner that a plurality of element circuits controlled partially in an operating state or a non-operating state are connected in parallel, wherein said bias circuit generates a current signal controlled in such a manner that a driving voltage of the transistor is a certain fixed value; and wherein the total of the product of a channel width and the number of the transistors of the element circuit controlled in the operating state in said signal processing circuit is inversely proportional to the current signal.

5. The semiconductor circuit according to claim 4, wherein the current signal is proportional to the coefficient β of the transistor.

6. A semiconductor circuit, comprising:

a bias circuit generating a signal reflecting a current driving capability of a transistor;

an analog/digital converter circuit converting the signal from an analog format into a digital format; and a signal processing circuit partially controlled in an operating state or a non-operating state according to the signal converted by said analog/digital converter circuit as a control signal, wherein said signal processing circuit is configured in such a manner that a plurality of element circuits controlled partially in an operating state or a non-operating state are connected in parallel, wherein said signal processing circuit includes a current mirror through which the plurality of the element circuits copy current according to a reference current, and wherein the current mirror includes a first element circuit to be in an operating state irrespective of the control signal, and a second element circuit to be in an operating state or a non-operating state according to the control signal.

7. The semiconductor circuit according to claim 6, wherein the reference current is a current of fixed magnitude.

8. The semiconductor circuit according to claim 6, wherein the reference current is a current proportional to a current signal controlled in such a manner that a driving voltage of the transistor is at a fixed value.

9. The semiconductor circuit according to claim 6, wherein the plurality of element circuits are provided at each of a plurality of bit signals in a digital format respectively.

10. The semiconductor circuit according to claim 6, wherein the plurality of element circuits connected in parallel are amplification circuits amplifying input signals respectively.

11. A method of controlling a semiconductor circuit, comprising:

generating a signal reflecting a current driving capability of a transistor in a bias circuit;

converting the signal from an analog format into a digital format; and partially controlling a signal processing circuit in an operating state or a non-operating state according to the converted signal as a control signal, wherein said signal processing circuit is configured in such a manner that a plurality of element circuits controlled partially in an operating state or a non-operating state are connected in parallel, wherein said bias circuit generates a current signal controlled in such a manner that transconductance of the transistor is a certain fixed value; and wherein the total of the product of the channel width and the number of transistors of the element circuits controlled in the operating state in said signal processing circuit is proportional to the current signal.

12. A method of controlling a semiconductor circuit, comprising:

generating a signal reflecting a current driving capability of a transistor in a bias circuit;

converting the signal from an analog format into a digital format; and partially controlling a signal processing circuit in an operating state or a non-operating state according to the converted signal as a control signal, wherein said signal processing circuit is configured in such a manner that a plurality of element circuits controlled partially in an operating state or a non-operating state are connected in parallel, wherein said bias circuit generates a current signal controlled in such a manner that a driving voltage of the transistor is a certain fixed value; and wherein the total of the product of a channel width and the number of the transistors of the element circuit controlled in the operating state in said signal processing circuit is inversely proportional to the current signal.

* * * * *